US008444540B2

(12) United States Patent
Parks et al.

(10) Patent No.: US 8,444,540 B2
(45) Date of Patent: May 21, 2013

(54) PRESSURE REDUCING FOLDING SYSTEM THAT ADAPTS TO BOOKLET THICKNESS

(75) Inventors: Ian Parks, St. Albans (GB); Richard Hubbard, Southhill (GB); Jeff Ryan, Knebworth (GB); Stephen May, Stotfold (GB); Martin Lloyd, Waltham Cross (GB)

(73) Assignee: Xerox Corporation, Norwalk, CT (US)

( * ) Notice: Subject to any disclaimer, the term of this patent is extended or adjusted under 35 U.S.C. 154(b) by 388 days.

(21) Appl. No.: 12/824,589

(22) Filed: Jun. 28, 2010

(65) Prior Publication Data

US 2011/0316214 A1 Dec. 29, 2011

(51) Int. Cl.
*B31F 1/10* (2006.01)

(52) U.S. Cl.
USPC ..... 493/444; 493/443; 493/442; 493/454; 493/455

(58) Field of Classification Search
USPC ..... 493/442–445, 454–455, 446
See application file for complete search history.

(56) References Cited

U.S. PATENT DOCUMENTS

| | | | | |
|---|---|---|---|---|
| 3,954,258 | A * | 5/1976 | Skipor et al. | 493/445 |
| 7,871,065 | B2 * | 1/2011 | Fukasawa et al. | 270/37 |
| 2008/0318752 | A1 * | 12/2008 | Oshiro et al. | 493/424 |
| 2009/0200724 | A1 * | 8/2009 | Iguchi et al. | 270/8 |

OTHER PUBLICATIONS

Richard Hubbard et al.; "Pressure Reducing Folding System" ; U.S. Appl. No. 12/432,153, filed Apr. 29, 2009.

* cited by examiner

*Primary Examiner* — Christopher Harmon
(74) *Attorney, Agent, or Firm* — Ronald E. Prass, Jr.; Prass LLP

(57) ABSTRACT

A device for folding sheets of a medium into a booklet is provided. The device includes a frame; a cam mechanism attached to the frame; a lever attached to the frame, the lever being actuated by the cam mechanism; a first scissor arm attached to the frame, the first scissor arm being actuated by the lever; a pair of first rolls, one of the first rolls being movable by the first scissor arm; a second scissor arm attached to the frame, the second scissor arm being actuated by the lever; a pair of second rolls, one of the second rolls being movable by the second scissor arm; a crease blade for contacting the sheets to create a crease in the sheets; and a controller that controls a position of the crease blade, a gap between the pair of first rolls, and a gap between the pair of second rolls.

16 Claims, 9 Drawing Sheets

PRESSURE REDUCING FOLDING SYSTEM THAT ADAPTS TO BOOKLET THICKNESS

BACKGROUND

Disclosed herein is a system and method for reducing the pressure applied to a stack of printed pages during a folding process.

An example of an application for a system for reducing the pressure applied to a stack of printed pages is a photocopier or printer that produces folded booklets.

In some booklet making systems, pressure is applied to the fold nip as the folded booklet is passed through. With warm solid inks, for example, "blocking" or image transfer can occur if the folded set is passed through a high pressure nip. This blocking or image transfer is undesirable.

SUMMARY

A device for folding sheets of a medium into a booklet is provided. The device includes a frame; a cam mechanism attached to the frame; a lever attached to the frame, the lever being actuated by the cam mechanism; a first scissor arm attached to the frame, the first scissor arm being actuated by the lever; a pair of first rolls, one of the first rolls being movable by the first scissor arm; a second scissor arm attached to the frame, the second scissor arm being actuated by the lever; a pair of second rolls, one of the second rolls being movable by the second scissor arm; a crease blade for contacting the sheets to create a crease in the sheets; and a controller that controls a position of the crease blade, a gap between the pair of first rolls, and a gap between the pair of second rolls. The rotation of the cam mechanism through a first period of rotation causes the crease blade to move in a contact direction to create the crease in the sheets by pushing the sheets between the first rolls, the rotation of the cam mechanism through a second period of rotation causes the crease blade to move in a retracting direction away from the sheets, the gap between the pair of first rolls is controlled by the controller based on a total thickness of the sheets to be folded, and the position of the crease blade is controlled by the controller based on the total thickness of the sheets to be folded.

DETAILED DESCRIPTION

Figure 1:
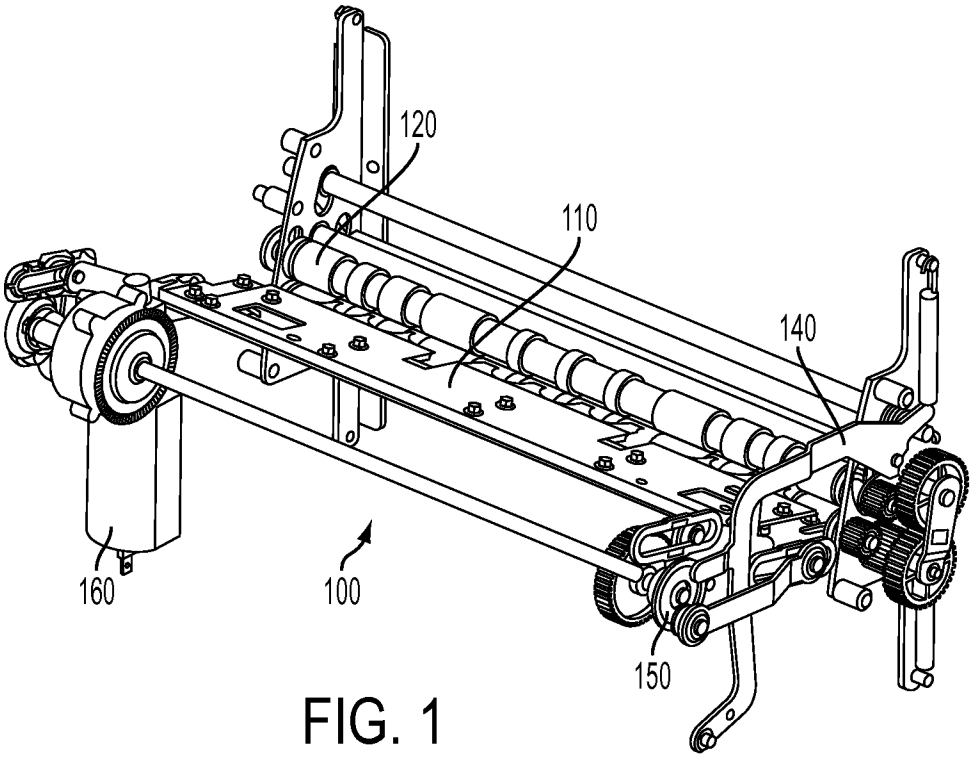
FIG. 1 is a diagram of an exemplary folding system in accordance with one possible embodiment of the disclosure.

Aspects of the embodiments disclosed herein relate to a system and method for folding sheets of a printed medium. For example, a saddle stitching booklet maker system can use embodiments of the disclosure to produce booklets with little or no image transfer or blocking. By controlling the separation of pressure rolls that crease the booklet, blocking can be reduced or eliminated while still maintain sufficient pressure to properly drive the booklet out of the mechanism.

The disclosed embodiments may include a device for folding sheets of a medium into a booklet. The device has a frame; a cam mechanism attached to the frame; a lever attached to the frame, the lever being actuated by the cam mechanism; a first scissor arm attached to the frame, the first scissor arm being actuated by the lever; a pair of first rolls, one of the first rolls being movable by the first scissor arm; a second scissor arm attached to the frame, the second scissor arm being actuated by the lever; a pair of second rolls, one of the second rolls being movable by the second scissor arm; a crease blade for contacting the sheets to create a crease in the sheets; and a controller that controls a position of the crease blade, a gap between the pair of first rolls, and a gap between the pair of second rolls. The rotation of the cam mechanism through a first period of rotation causes the crease blade to move in a contact direction to create the crease in the sheets by pushing the sheets between the first rolls, the rotation of the cam mechanism through a second period of rotation causes the crease blade to move in a retracting direction away from the sheets, the gap between the pair of first rolls is controlled by the controller based on a total thickness of the sheets to be folded, and the position of the crease blade is controlled by the controller based on the total thickness of the sheets to be folded.

The disclosed embodiments may further include a printing device. The device has a medium storage area; and a folding device for folding sheets of a medium being printed into a booklet. The folding device has a frame; a cam mechanism attached to the frame; a lever attached to the frame, the lever being actuated by the cam mechanism; a first scissor arm attached to the frame, the first scissor arm being actuated by the lever; a pair of first rolls, one of the first rolls being movable by the first scissor arm; a second scissor arm attached to the frame, the second scissor arm being actuated by the lever; a pair of second rolls, one of the second rolls being movable by the second scissor arm; a crease blade for contacting the sheets to create a crease in the sheets; and a controller that controls a position of the crease blade, a gap between the pair of first rolls, and a gap between the pair of second rolls. The rotation of the cam mechanism through a first period of rotation causes the crease blade to move in a contact direction to create the crease in the sheets by pushing the sheets between the first rolls, the rotation of the cam mechanism through a second period of rotation causes the crease blade to move in a retracting direction away from the sheets, the gap between the pair of first rolls is controlled by the controller based on a total thickness of the sheets to be folded, and the position of the crease blade is controlled by the controller based on the total thickness of the sheets to be folded.

The disclosed embodiments may further include a method for folding sheets of a medium into a booklet. The method includes rotating a cam mechanism through a first period of rotation to cause a crease blade to move in a contact direction to create a crease in the sheets by pushing the sheets between a pair of first rolls; rotating the cam mechanism through a second period of rotation to cause the crease blade to move in a retracting direction away from the sheets; controlling a gap between the pair of first rolls based on a total thickness of the sheets to be folded; and controlling a position of the crease blade based on the total thickness of the sheets to be folded.

Figure 5:
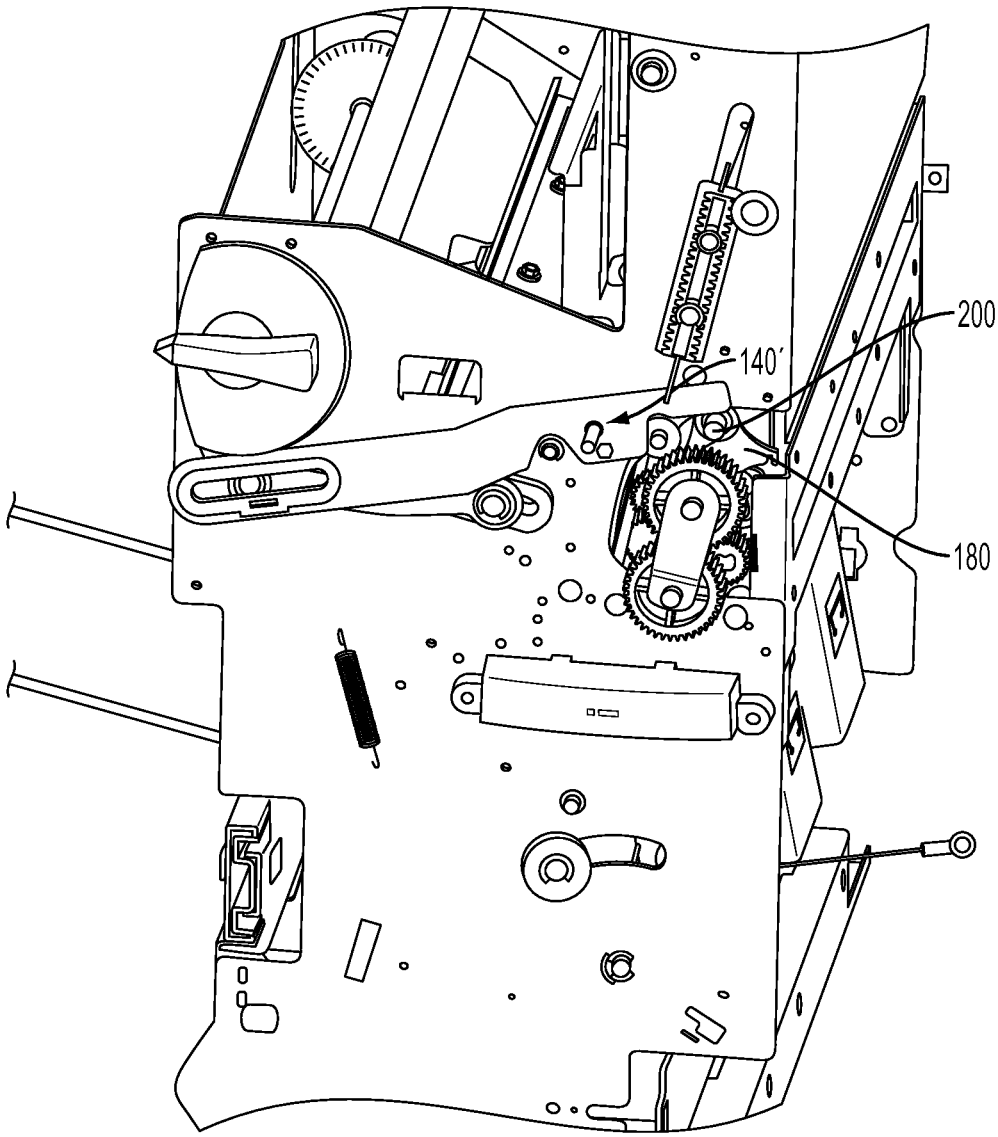
FIG. 5. is an exemplary diagram of a folding system in accordance with one possible embodiment of the disclosure.
Figure 6:
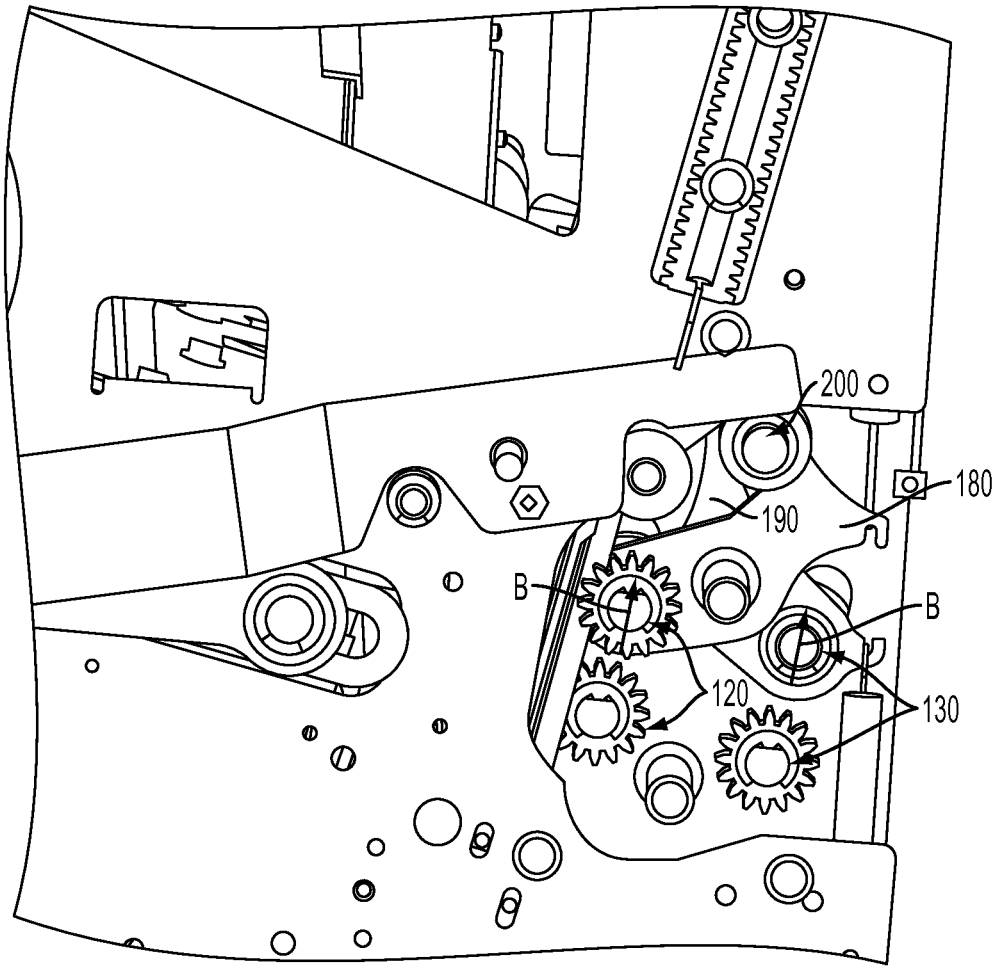
FIG. 6. is another view of the folding system shown in FIG. 5.
Figure 7:
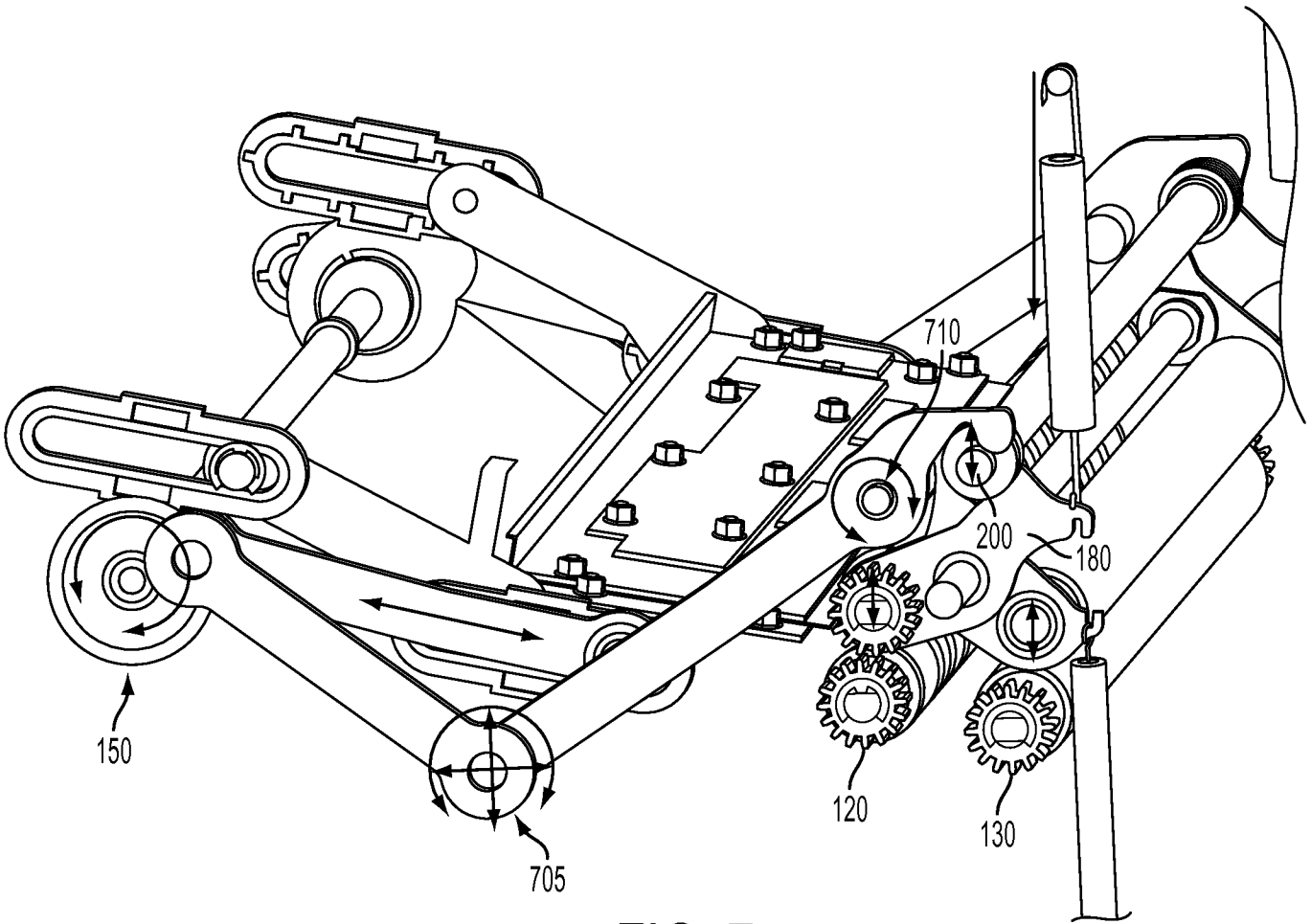
FIG. 7 is an exemplary diagram of a folding system in accordance with one possible embodiment of the disclosure.

FIGS. 1-4 show a first exemplary embodiment of a system in accordance with the disclosure. FIGS. 5 and 6 show a second embodiment of a system in accordance with the disclosure. FIG. 7 shows a third embodiment of a system in accordance with the disclosure.

FIG. 1 is a partial view of an example of a system using an embodiment of the disclosure. FIG. 1 shows an assembly 100 for producing a fold in a stack of printed pages. Assembly 100 has a crease blade 110 that creates a crease in the stack of printed pages. Crease blade 110 is moved toward a first pair of pressure rolls 120 to push the stack of printed pages into and between first pair of pressure rolls 120. A cam mechanism 150 actuates a lever 140 that, in turn, actuates a scissor arm that controls a gap between the first pair of pressure rolls 120. In this disclosure, a "cam" may be defined as a rotating or sliding piece in a mechanical linkage used to at least in part transform rotary motion into linear motion, for example. Lever 140 also actuates a scissor arm that controls a gap between a second pair of pressure rolls 130 (not shown in FIG. 1). In this disclosure, the term "scissor arm" may be defined as one of a pair of arms that are pivotably mounted relative to each other, for example. A drive motor 160 drives cam mechanism 150. A single motor 160 can be used to drive cam mechanism 150 and crease blade 110, or multiple motors can be used.

Figure 2:
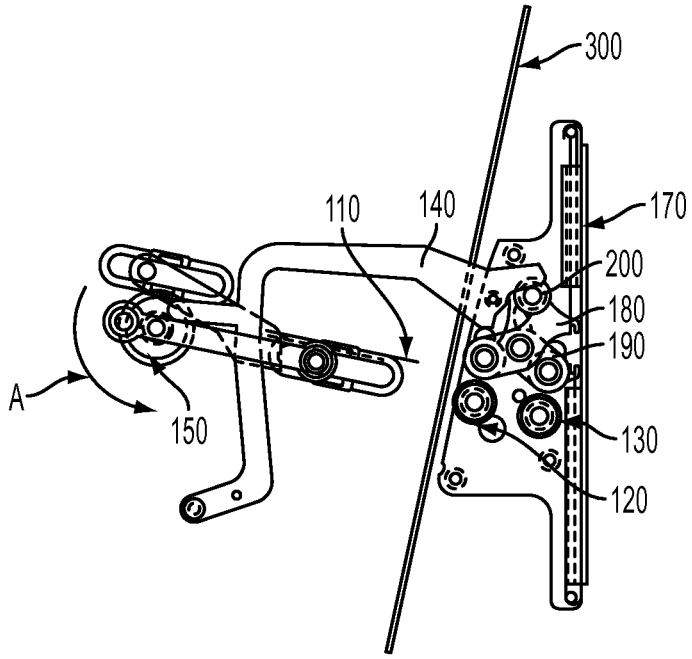
FIG. 2 is an exemplary diagram of a folding system in accordance with one possible embodiment of the disclosure at a first position.
Figure 3:
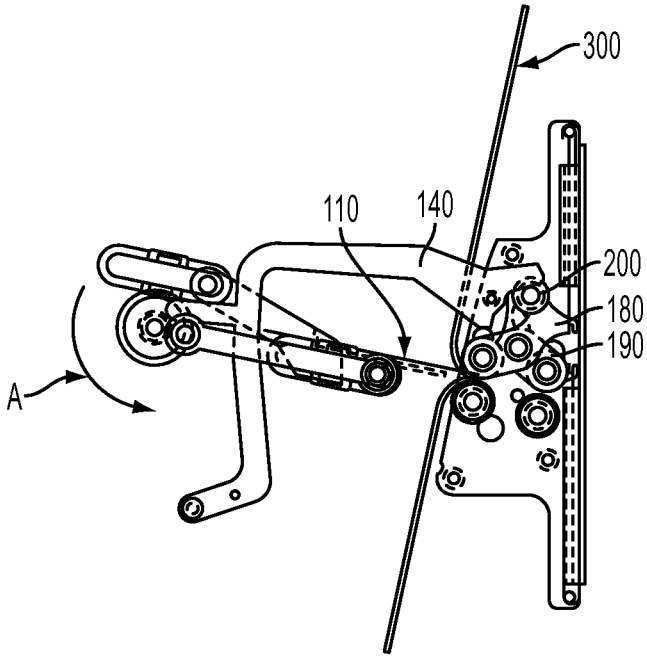
FIG. 3 is an exemplary diagram of a folding system in accordance with one possible embodiment of the disclosure at a second position.
Figure 4:
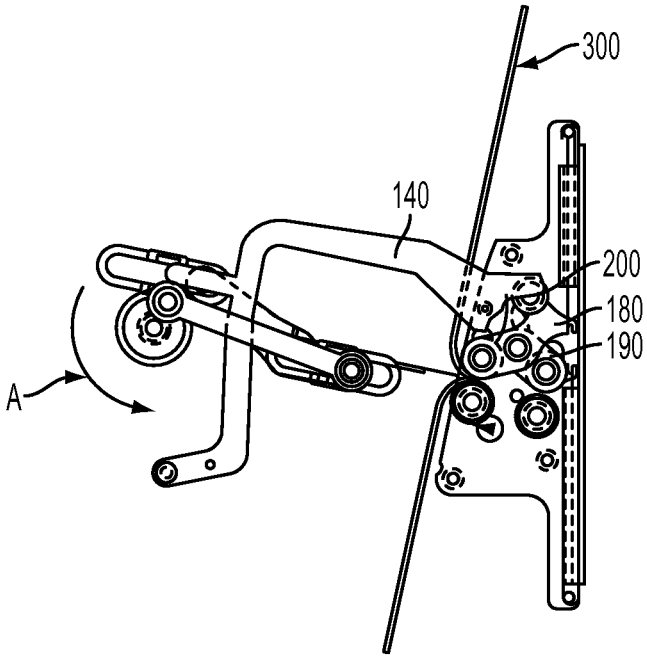
FIG. 4 is an exemplary diagram of a folding system in accordance with one possible embodiment of the disclosure at a third position.

FIGS. 2-4 show an example of the operation of Assembly 100.

FIG. 2 shows assembly 100 with crease blade 110 in the back position while sheets 300 are moved into position for folding. FIG. 2 shows second pair of pressure rolls 130 located downstream of first pair of pressure rolls 120. A first scissor arm 180 is attached to the upper roll of first pair of pressure rolls 120. A second scissor arm 190 is attached to the upper roll of second pair of pressure rolls 130. A pin 200 transfers motion from level 140 to scissor arms 180, 190. Springs 170 apply force to scissor arms 180, 190 that is in turn applied to pressure rolls 120, 130. As cam mechanism 150 rotates in the direction of arrow A, crease blade 110 moves toward sheets 300 to the position shown in FIG. 3.

FIG. 3 shows crease blade 110 in the forward position pushing sheets 300 into the nip between first pair of pressure rolls 120. As cam mechanism 150 continues to rotate in direction A, lever 140 is moved such that downward force is applied to pin 200. As pin 200 is pushed downward in FIG. 3, first scissor arm 180 rotates to lift the upper roll of first pair of pressure rolls 120 and, as a result, decrease the pressure applied to sheets 300. Similarly, as pin 200 is pushed downward in FIG. 3, second scissor arm 190 rotates to lift the upper roll of second pair of pressure rolls 130 and, as a result, decrease the pressure applied to sheets 300 as they progress through second pair of pressure rolls 130. In one embodiment, the upper roll of first pair of pressure rolls 120 is lifted after crease blade 110 is inserted approximately 5 to 6 mm into the nip. By decreasing the pressure applied to sheets 300 by the pressure rolls, blocking can be reduced or eliminated. By allowing crease blade 110 to be inserted into the nip for a short distance before reducing the pressure applied by the pressure rolls, a satisfactory fold can be achieved with little or no blocking.

The timing of the pressure reduction at second pair of pressure rolls 130 relative to the pressure reduction at first pair of pressure rolls 120 can be dictated by the shapes of scissor arms 180, 190. In some embodiments, the pressure reduction at second pair of pressure rolls 130 is activated after the pressure reduction at first pair of pressure rolls 120. In other embodiments, the pressure reduction at both pairs of pressure rolls is simultaneous, or the pressure is reduced at second pair of pressure rolls 130 first.

As cam mechanism 150 continues to rotate, crease blade 110 is moved to the position shown in FIG. 4.

In FIG. 4, crease blade 110 is shown in the stop position where it does not contact sheets 300. Crease blade 110 is held in this position until sheets 300 are clear of the pressure rolls. After sheets 300 (in the form of a booklet) have cleared the pressure rolls, cam mechanism 150 begins to rotate to return to the position shown in FIG. 2, which releases lever 140 and permits full pressure to be restored at the pressure rolls.

FIGS. 5 and 6 show partial views of an assembly in accordance with another embodiment of the disclosure. This embodiment operates similarly to the embodiment shown in FIGS. 2-4, but has fewer parts and uses a lever 140' that is shaped differently.

FIG. 6 shows in closer detail how the movement of lever 140' pushing pin 200 downward causes first scissor arm 180 to lift the upper roll of first pair of pressure rolls 120 upward in direction B. Similarly, the movement of lever 140' pushing pin 200 downward causes second scissor arm 190 to lift the upper roll of second pair of pressure rolls 130 upward in direction B.

FIG. 7 is a partial view of an example of a system using an embodiment of the disclosure. The operation of the system shown in FIG. 7 is similar to the embodiments shown in FIGS. 1-6. As cam mechanism 150 rotates and crease blade 110 moves to the right to crease sheets 300 and push sheets 300 into pressure rolls 120, pivots 705 and 710 move and cause pin 200 to move upwards. This causes first scissor arm 180 to push the upper roll of first pair of pressure rolls 120 downward fully closing pressure rolls 120. Similarly, the movement of pin 200 upward causes second scissor arm 190 to push the upper roll of second pair of pressure rolls 130 downward fully closing pressure rolls 130. As sheets 300 move through the closed pressure rolls 120, a neat fold in the lead edge of sheets 300 is created. A controller pauses cam mechanism 150 as sheets 300 pass through pressure rolls 130 to further crease the fold. The controller can be any appropriate form of controller including, but not limited to, a mechanical mechanism, or a micro processor or other electronic controller. In particular embodiments, the controller reciprocates sheets 300 between pressure rolls 130 a plurality of times to further crease the fold. The controller can rotate cam mechanism 150 a predetermined amount based on the thickness and number of sheets 300. Further rotation of cam mechanism 150 causes, through pivots 705 and 710, pin 200 to move downward which causes pressure rolls 120 and 130 to open slightly. The thickness of the booklet (sheets 300) and the relaxation of the fold result in sufficient force being applied to the booklet for it to continue its movement to the right in the figure without causing blocking.

Particular embodiments of the disclosure, including examples of the embodiment shown in FIG. 7, ensure that when crease blade 110 is in the fully removed position, pressure rolls 120 and 130 are in the fully open position. This results in the advantage of not needed a separate set of handles and levers for opening pressure rolls 120 and 130 in the event of a paper jam because moving the blade will also move the pressure rolls.

Figure 8:
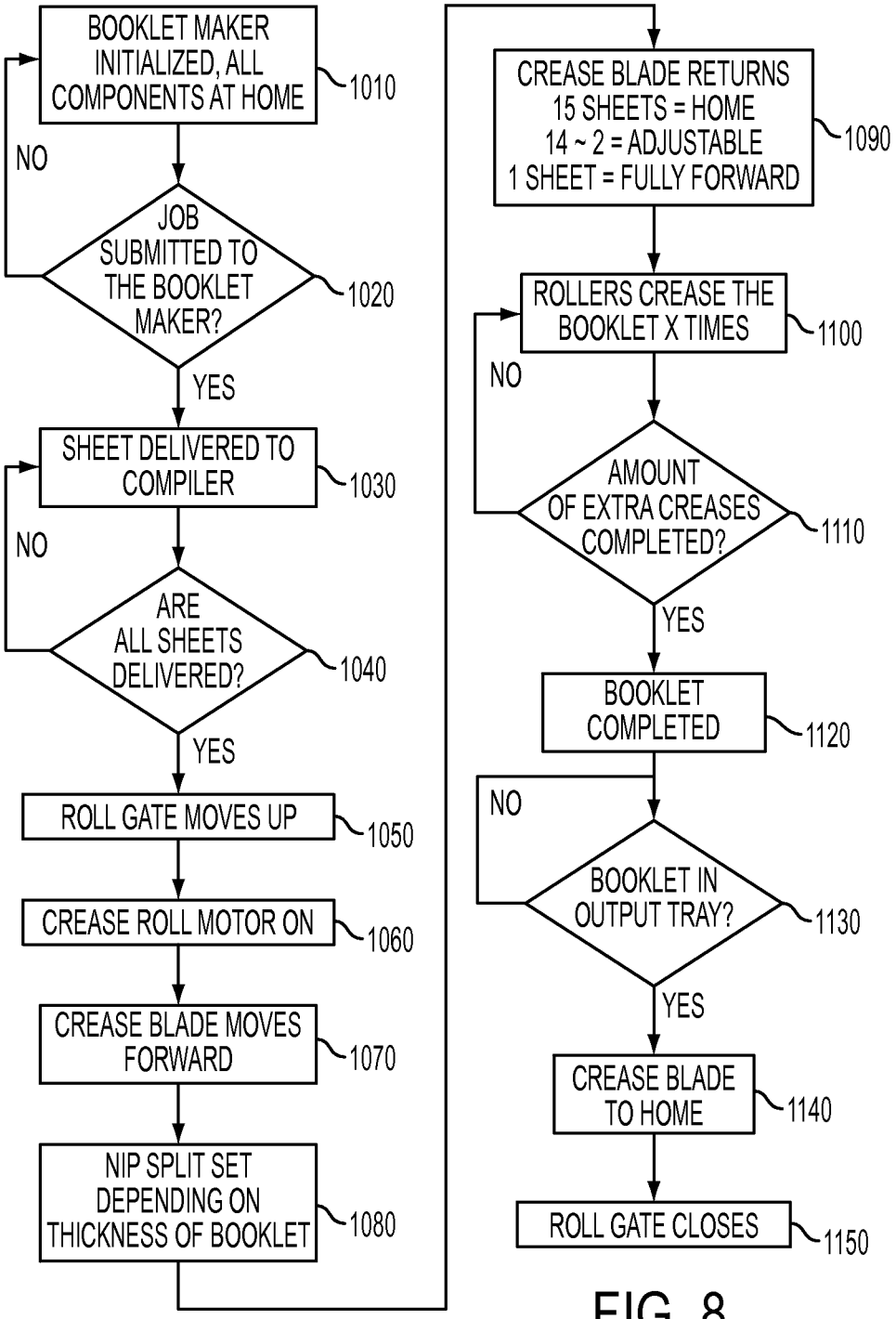
FIG. 8 is a flow chart showing an exemplary embodiment of the disclosure.

FIG. 8 is a flowchart showing an exemplary process in accordance with particular embodiments of the disclosure. In block 1010 the booklet maker is initialized and all components are in their home positions. In block 1020 it is determined whether a job has been submitted to the booklet maker. Once a job is submitted to the booklet maker, the process continues to block 1030 where a first sheet is delivered to the compiler. In block 1040 it is determined whether all sheets of the job have been delivered to the compiler. Once all sheets have been delivered to the compiler, the process continues to block 1050 where a roll gate moves up. The roll gate can be a sheet metal plate that moves vertically relative to crease blade 110 between crease blade 110 and first pair of pressure rolls 120. When in a lowered position, the roll gate prevents the leading edges of sheets 300 from entering the gap between first pair of pressure rolls 120. When in a raised position, the roll gate allows the leading edges of sheets 300 to enter the gap between first pair of pressure rolls 120. In block 1060 the crease roll motor is switched on and in block 1070 the crease blade moves forward to press the sheets into the pressure rolls. In block 1080, the nip split of pressure rolls 120 and 130 is set depending on the thickness of the stack of sheets. In block 1090 the crease blade's position is adjusted based on the thickness of the booklet, which is dependent on the number of sheets and the thickness of the sheets. In this example, the crease blade returns to its home position if there are 15 sheets, stays in its fully forward position if there is only one sheet, and is moved to an intermediate position if there are two to 14 sheets. These numbers of sheets are only examples. The nip split and blade position at this point in the routine are determined based on the thickness of the stack of sheets so that the desired amount of pressure is applied to the folded booklet. The desired amount of pressure is the amount that is sufficient to form a proper crease without resulting in blocking. In blocks 1100 and 1110 the booklet is moved back and forth and creased by the pressure rolls a predetermined number of times. After the desired number of creasing passes have been completed, the process continues to block 1120 as the booklet is completed and moved to the output tray. Once it is determined that the booklet is in the output tray in block 1130, the process continues to block 1140 where the crease blade returns to its home position and to block 1150 where the roll gate closes. At this point the booklet maker is ready to receive the next booklet.

Figure 9:
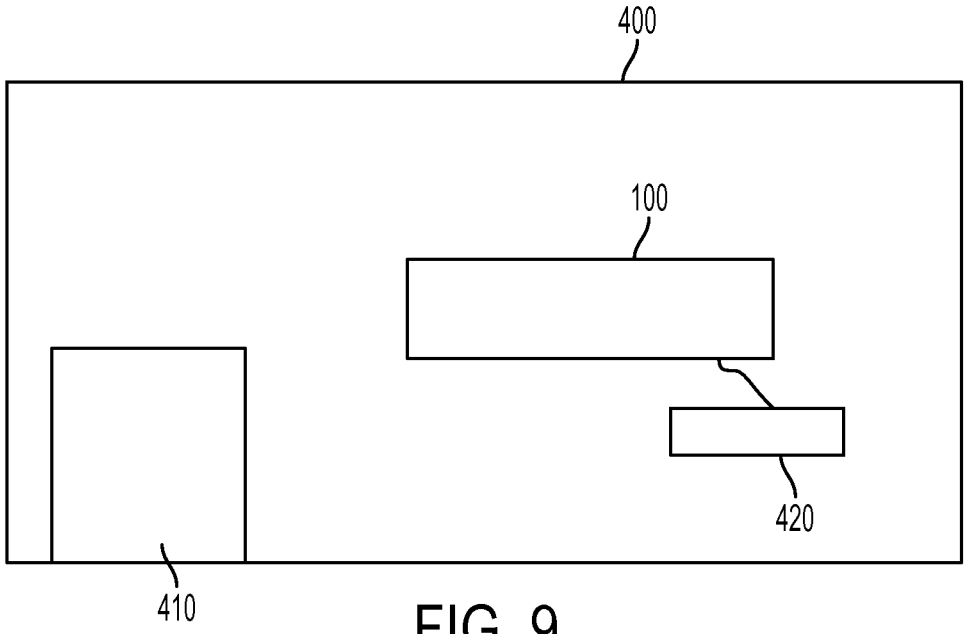
FIG. 9 is an exemplary schematic diagram of a printing device in accordance with one possible embodiment of the disclosure.

FIG. 9 shows a printing device 400 including assembly 100, a media storage area 410, and a controller 420. Controller 420 controls the operation of assembly 100. Sheets 300 are stored in media storage area 410 prior to processing through assembly 100.

Particular ones of the exemplary embodiments described herein can be used in any machine that folds printed sheets. However, blocking is particularly problematic in machines that print in color.

The claims can encompass embodiments in hardware, software, or a combination thereof.

The word "printer" as used herein encompasses any apparatus, such as a digital copier, bookmaking machine, facsimile machine, multi-function machine, and the like, which performs a print outputting function for any purpose.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A device for folding sheets of a medium into a booklet, the device comprising:

a frame;

a cam mechanism attached to the frame;

a lever attached to the frame, the lever being actuated by the cam mechanism;

a first scissor arm attached to the frame, the first scissor arm being actuated by the lever;

a pair of first rolls, one of the first rolls being movable by the first scissor arm;

a second scissor arm attached to the frame, the second scissor arm being actuated by the lever;

a pair of second rolls, one of the second rolls being movable by the second scissor arm;

a crease blade for contacting the sheets to create a crease in the sheets; and a controller that controls a position of the crease blade, a gap between the pair of first rolls, and a gap between the pair of second rolls, wherein rotation of the cam mechanism through a first period of rotation causes the crease blade to move in a contact direction to create the crease in the sheets by pushing the sheets between the first rolls, rotation of the cam mechanism through a second period of rotation causes the crease blade to move in a retracting direction away from the sheets, the gap between the pair of first rolls is controlled by the controller based on a total thickness of the sheets to be folded, the position of the crease blade is controlled by the controller based on the total thickness of the sheets to be folded, and the controller reverses the direction of rotation of the first rolls multiple times to cause the booklet to be creased multiple times.

2. The device of claim 1, wherein the gap between the pair of second rolls is controlled by the controller based on the total thickness of the sheets to be folded.

3. The device of claim 1, wherein the controller controls the gap between the pair of first rolls based on the number of the sheets to be folded.

4. The device of claim 1, wherein the controller separates the pair of first rolls to a fully open position when the controller retracts the crease blade to a fully retracted position.

5. A device for folding sheets of a medium into a booklet, the device comprising:

a frame;

a cam mechanism attached to the frame;

a lever attached to the frame, the lever being actuated by the cam mechanism;

a first scissor arm attached to the frame, the first scissor arm being actuated by the lever;

a pair of first rolls, one of the first rolls being movable by the first scissor arm;

a second scissor arm attached to the frame, the second scissor arm being actuated by the lever;

a pair of second rolls, one of the second rolls being movable by the second scissor arm;

a crease blade for contacting the sheets to create a crease in the sheets; and a controller that controls a position of the crease blade, a gap between the pair of first rolls, and a gap between the pair of second rolls, wherein rotation of the cam mechanism through a first period of rotation causes the crease blade to move in a contact direction to create the crease in the sheets by pushing the sheets between the first rolls, rotation of the cam mechanism through a second period of rotation causes the crease blade to move in a retracting direction away from the sheets, the gap between the pair of first rolls is controlled by the controller based on a total thickness of the sheets to be folded, the position of the crease blade is controlled by the controller based on the total thickness of the sheets to be folded, the rotation of the cam mechanism is stopped for a period of time after the crease blade has moved to a retracted position, and the controller reverses the direction of rotation of the first rolls multiple times after the crease blade has moved to the retracted position to cause the booklet to be creased multiple times.

6. The device of claim 5, wherein the gap between the pair of second rolls is controlled by the controller based on the total thickness of the sheets to be folded.

7. The device of claim 5, wherein the controller controls the gap between the pair of first rolls based on the number of the sheets to be folded.

8. The device of claim 5, wherein the controller separates the pair of first rolls to a fully open position when the controller retracts the crease blade to a fully retracted position.

9. A printing device, comprising:

a medium storage area; and a folding device for folding sheets of a medium being printed into a booklet, the folding device having a frame;

a cam mechanism attached to the frame;

a lever attached to the frame, the lever being actuated by the cam mechanism;

a first scissor arm attached to the frame, the first scissor arm being actuated by the lever;

a pair of first rolls, one of the first rolls being movable by the first scissor arm;

a second scissor arm attached to the frame, the second scissor arm being actuated by the lever;

a pair of second rolls, one of the second rolls being movable by the second scissor arm;

a crease blade for contacting the sheets to create a crease in the sheets; and a controller that controls a position of the crease blade, a gap between the pair of first rolls, and a gap between the pair of second rolls, wherein rotation of the cam mechanism through a first period of rotation causes the crease blade to move in a contact direction to create the crease in the sheets by pushing the sheets between the first rolls, rotation of the cam mechanism through a second period of rotation causes the crease blade to move in a retracting direction away from the sheets, the gap between the pair of first rolls is controlled by the controller based on a total thickness of the sheets to be folded, the position of the crease blade is controlled by the controller based on the total thickness of the sheets to be folded, and the controller reverses the direction of rotation of the first rolls multiple times to cause the booklet to be creased multiple times.

10. The device of claim 9, wherein the gap between the pair of second rolls is controlled by the controller based on the total thickness of the sheets to be folded.

11. The device of claim 9, wherein the controller controls the gap between the pair of first rolls based on the number of the sheets to be folded.

12. The device of claim 9, wherein the controller separates the pair of first rolls to a fully open position when the controller retracts the crease blade to a fully retracted position.

13. A printing device, comprising:

a medium storage area; and a folding device for folding sheets of a medium being printed into a booklet, the folding device having a frame;

a cam mechanism attached to the frame;

a lever attached to the frame, the lever being actuated by the cam mechanism;

a first scissor arm attached to the frame, the first scissor arm being actuated by the lever;

a pair of first rolls, one of the first rolls being movable by the first scissor arm;

a second scissor arm attached to the frame, the second scissor arm being actuated by the lever;

a pair of second rolls, one of the second rolls being movable by the second scissor arm;

a crease blade for contacting the sheets to create a crease in the sheets; and a controller that controls a position of the crease blade, a gap between the pair of first rolls, and a gap between the pair of second rolls, wherein rotation of the cam mechanism through a first period of rotation causes the crease blade to move in a contact direction to create the crease in the sheets by pushing the sheets between the first rolls, rotation of the cam mechanism through a second period of rotation causes the crease blade to move in a retracting direction away from the sheets, the gap between the pair of first rolls is controlled by the controller based on a total thickness of the sheets to be folded, the position of the crease blade is controlled by the controller based on the total thickness of the sheets to be folded, the rotation of the cam mechanism is stopped for a period of time after the crease blade has moved to a retracted position, and the controller reverses the direction of rotation of the first rolls multiple times after the crease blade has moved to the retracted position to cause the booklet to be creased multiple times.

14. The device of claim 13, wherein the gap between the pair of second rolls is controlled by the controller based on the total thickness of the sheets to be folded.

15. The device of claim 13, wherein the controller controls the gap between the pair of first rolls based on the number of the sheets to be folded.

16. The device of claim 13, wherein the controller separates the pair of first rolls to a fully open position when the controller retracts the crease blade to a fully retracted position.

* * * * *